US007240600B1

(12) United States Patent
Bordson

(10) Patent No.: US 7,240,600 B1
(45) Date of Patent: Jul. 10, 2007

(54) RIFLE CHARGING HANDLE WITH AMBIDEXTROUS LATCH

(76) Inventor: Martin J. Bordson, 3803 NW. 52nd Tr., Kansas City, MO (US) 64151

( * ) Notice: Subject to any disclaimer, the term of this patent is extended or adjusted under 35 U.S.C. 154(b) by 347 days.

(21) Appl. No.: 10/876,742

(22) Filed: Jun. 25, 2004

(51) Int. Cl.
*B64D 1/04* (2006.01)

(52) U.S. Cl. ..... 89/1.4; 89/191.01; 89/192; 42/69.01; 42/69.02

(58) Field of Classification Search ..... 89/1.42, 89/1.4, 179, 191.01, 191.02, 192; 42/90, 42/69.01, 69.02; 294/19.1, 19.2, 28
See application file for complete search history.

(56) References Cited

U.S. PATENT DOCUMENTS

| | | | | | |
|---|---|---|---|---|---|
| 1,753,026 | A * | 4/1930 | Rosati | 81/3.37 |
| 2,475,329 | A * | 7/1949 | Leathers et al. | 74/625 |
| 2,591,638 | A * | 4/1952 | Trafton | 294/19.1 |
| 2,717,532 | A * | 9/1955 | Ramseyer | 89/1.4 |
| 3,219,376 | A * | 11/1965 | Peters | 294/19.1 |
| 3,225,653 | A * | 12/1965 | Packard | 89/1.4 |
| 3,796,242 | A * | 3/1974 | Albright | 144/34.1 |
| 4,521,985 | A * | 6/1985 | Smith et al. | 42/7 |
| 4,759,144 | A * | 7/1988 | Egan et al. | 42/7 |
| 4,827,652 | A * | 5/1989 | Martin | 42/142 |
| 4,834,437 | A * | 5/1989 | Howard, Sr. | 294/19.1 |
| 4,835,892 | A * | 6/1989 | Ruger et al. | 42/7 |
| 4,928,822 | A * | 5/1990 | Geisser | 206/716 |
| 5,109,752 | A * | 5/1992 | Yu | 89/33.17 |
| 5,174,057 | A * | 12/1992 | Sienel | 43/5 |
| 5,519,954 | A * | 5/1996 | Garrett | 42/6 |
| 5,606,825 | A * | 3/1997 | Olsen | 42/69.01 |
| 5,722,194 | A * | 3/1998 | Wurger et al. | 42/69.02 |
| 5,821,445 | A * | 10/1998 | Guhring | 89/1.42 |
| 6,151,824 | A * | 11/2000 | Clayton | 42/54 |
| 6,311,603 | B1 * | 11/2001 | Dunlap | 89/1.4 |
| 6,418,655 | B1 * | 7/2002 | Kay | 42/75.02 |
| 6,536,306 | B1 * | 3/2003 | Harris | 81/3.09 |
| 2001/0022131 | A1 * | 9/2001 | Moczijdlower et al. | 89/155 |
| 2006/0026883 | A1 * | 2/2006 | Hochstrate et al. | 42/75.01 |

* cited by examiner

*Primary Examiner*—J. Woodrow Eldred
(74) *Attorney, Agent, or Firm*—Langlotz Patent Works, Inc.; Bennet K. Langlotz

(57) ABSTRACT

A charging handle for a rifle having a housing. The handle has a body with an elongated bar having a forward end and a rear end. The bar has a bolt engaging element at the forward end, and a crossbar having an intermediate portion connected to the rear end of the bar. The crossbar has opposed ends extending laterally of the bar. First and second latch elements are connected to the body. The first latch element has a housing-engaging element that engages the housing when the handle is in a forward position. The first and second latch elements are engaged to each other such that pivoting of the second latch element disengages the housing-engaging element from the housing.

16 Claims, 2 Drawing Sheets

RIFLE CHARGING HANDLE WITH AMBIDEXTROUS LATCH

FIELD OF THE INVENTION

This invention relates to firearms, and more particularly to mechanisms for securing and releasing the action of an auto-loading rifle.

BACKGROUND OF THE INVENTION

The M-16 military rifle and its civilian counterparts have a T-shaped charging handle that is operated to open the rifle's action by pulling the bolt rearward. The handle has an elongated body with a crossbar at the rear end, so that a user generally operates the action by hooking the forefinger and middle finger of the right had over the ends of the crossbar and pulling it to the rear. The forward end of the handle engages the rifle's bolt. In the conventional rifle, the handle includes a spring-loaded L-shaped latch that pivots about a vertical axis in the left portion of the crossbar. The latch has a first leg that extends laterally from the axis, partially protruding forward of the left portion of the crossbar. A second leg of the latch extends forwardly, and has a hook that engages a recess in the receiver in which the draw bar reciprocates. The latch is spring-biased so that the hook presses into the receiver recess when the charging handle is in a forward position. This prevents the handle from moving rearward except when a user applies pressure to the first leg of the latch, which occurs naturally when deliberately pulling on the crossbar of the charging handle. This conventional latch is described and illustrated in U.S. Army Field manual FM 23-9, U.S. Army Technical manual TM 9-1005-249-10, and U.S. Army Technical manual TM 9-1005-319-10, which are incorporated herein by reference.

While effective in many instances, the existing latch configuration is not entirely suitable for operation in alternate modes than my be necessary. For instance, when an optical scope is mounted to the top of the receiver, there may be inadequate space for the user to hook two fingers over the charging handle crossbar. Consequently, a user seeking to draw the charging handle must access the handle crossbar from the side. In some instances, the user may not readily be able to access the left side, and the right side may be more reachable. However, because of the latch location, the user is forced to use the left side, which may be difficult, impossible, or slower than accessing the right end of the cross bar.

A modified latch (Tactical Latch 249-02, Badger Ordnance, North Kansas City, Mo.) has been suitable for some applications. The modified latch has an enlarged paddle on the first leg extending laterally beyond the left end of the charging handle crossbar. This makes the latch more accessible, and is advantageous for close quarters battle applications. It can be reached more readily by the alternate hand of the user, which may reach over or under the rifle to contact the protruding latch. However, this is less well suited to applications where protruding elements are subject to breakage or catching on other equipment.

SUMMARY OF THE INVENTION

The present invention overcomes the limitations of the prior art by providing a charging handle for a rifle having a housing. The handle has a body with an elongated bar having a forward end and a rear end. The bar has a bolt engaging element at the forward end, and a crossbar having an intermediate portion connected to the rear end of the bar. The crossbar has opposed ends extending laterally of the bar. First and second latch elements are connected to the body. The first latch element has a housing-engaging element that engages the housing when the handle is in a forward position. The first and second latch elements are engaged to each other such that pivoting of the second latch element disengages the housing-engaging element from the housing.

DETAILED DESCRIPTION OF A PREFERRED EMBODIMENT

Figure 1:
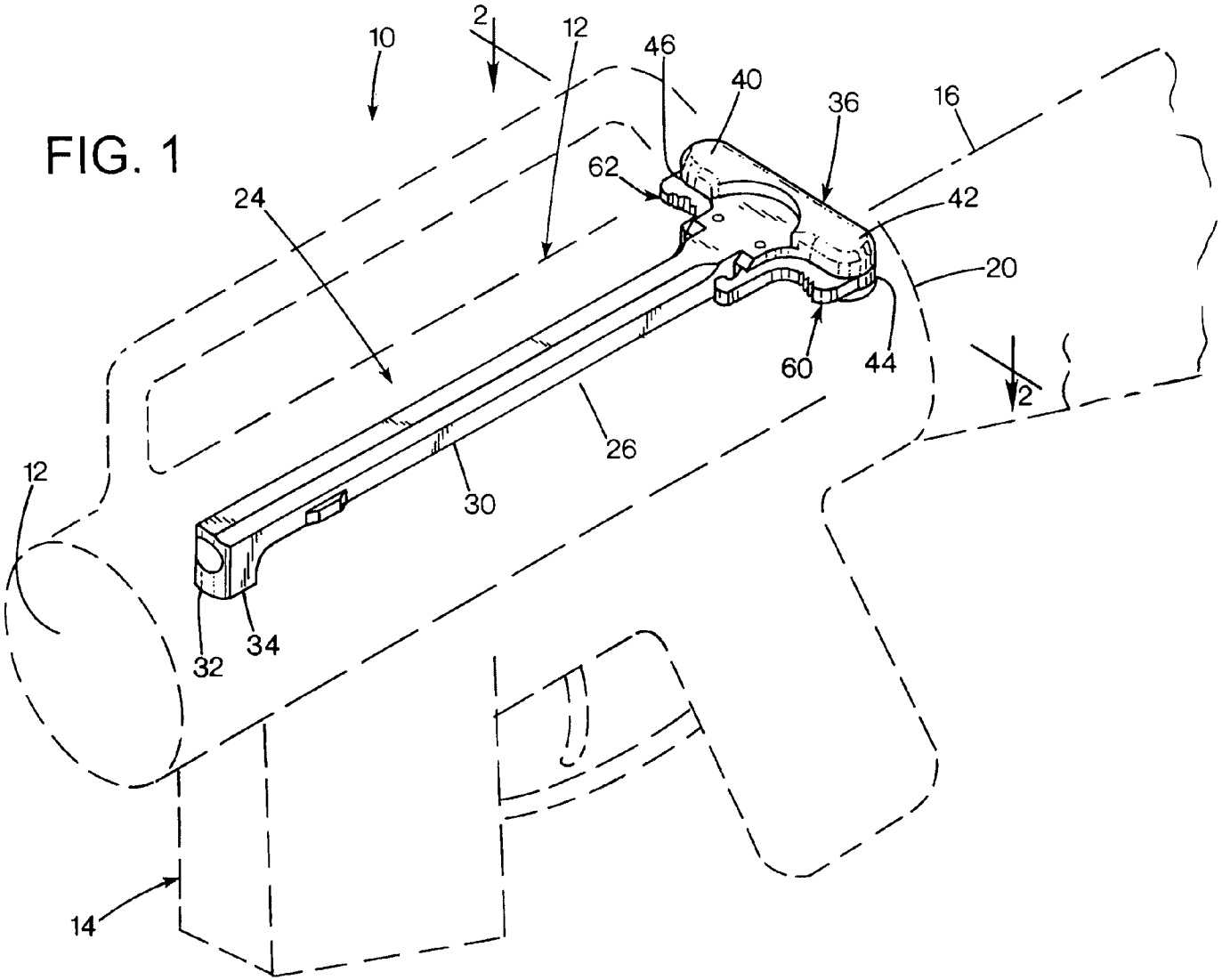
FIG. 1 is an isometric view of a rifle with a charging handle according to a preferred embodiment of the invention.

FIG. 1 shows an M-16 or AR-15 rifle 10 having an upper receiver 12 mated to a lower receiver 14. A buttstock 16 is connected to a rear end 20 of the lower receiver, and a barrel and handguard (not shown) are connected to a forward end 22 of the upper receiver.

A T-shaped charging handle 24 has an elongated body 26 with an elongated bar 30 having a forward end 32 with a hook 34 that engages a bolt (not shown). The bolt reciprocates within the upper receiver between a closed position in which the bolt is forward, and an open position in which the bolt is shifted rearward. The handle body 26 has an integral crossbar 36 connected to the rear end of the elongated bar. The crossbar is symmetrically positioned, perpendicular to the bar 30, with the crossbar having a right end 40 and left end 42 (directions indicated from the perspective of an operator aiming the rifle) protruding in opposite directions to equal distances.

Figure 2:
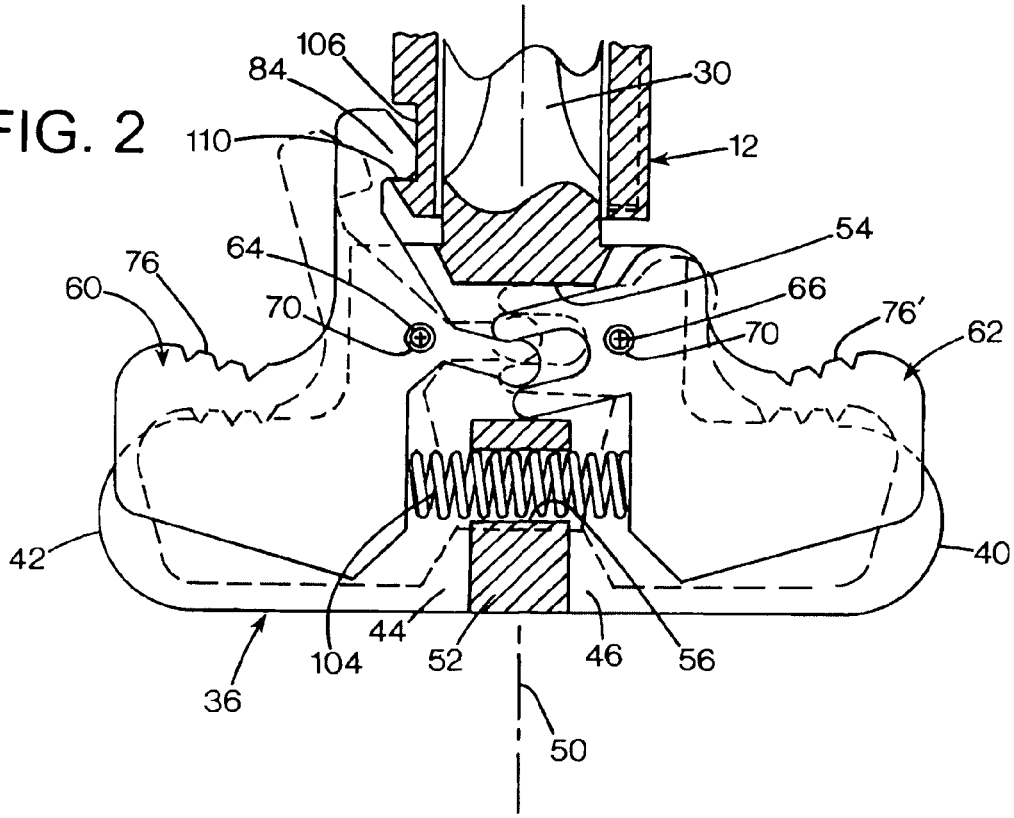
FIG. 2 is an enlarged sectional view of the handle taken along line 2-2 of FIG. 1.

Each end of the handle's crossbar is cut with a horizontal slot 44, 46 that is parallel to the major plane defined by the handle, and horizontal when the rifle is oriented for normal operation. As shown in FIG. 2, each slot extends medially toward a midline 50 of the handle, but to a limited depth toward the midline so that a web 52 remains to provide structural integrity of the handle. Thus, the upper and lower portions of the crossbar at the middle are vertically connected to prevent deflection and to provide strength. Two lateral passages are defined in the web 52. A forward passage 54 has upper and lower surfaces aligned with the upper and lower surfaces of the slots 44 and 46. A spring aperture 56 is defined in the web. The aperture is a right-to-left cylindrical bore having a diameter equal to the slot width, and is positioned rearward of the forward slot, and forward of the rear edge of the crossbar 36.

The handle includes a left latch element 60 and a right latch element 62, each partially received in the respective left slot 44 and right slot 46. The handle body 26 defines a pair of spaced apart pivot holes 64, 66, each receiving a press fit roll pin 70. The pivot holes are positioned in alignment with the forward aperture 54, and are spaced apart more widely than the width of the web 52. The latches are planar bodies having a thickness slightly less than the gap formed by the slots, so that they can pivot readily without excessive friction.

Figure 3:
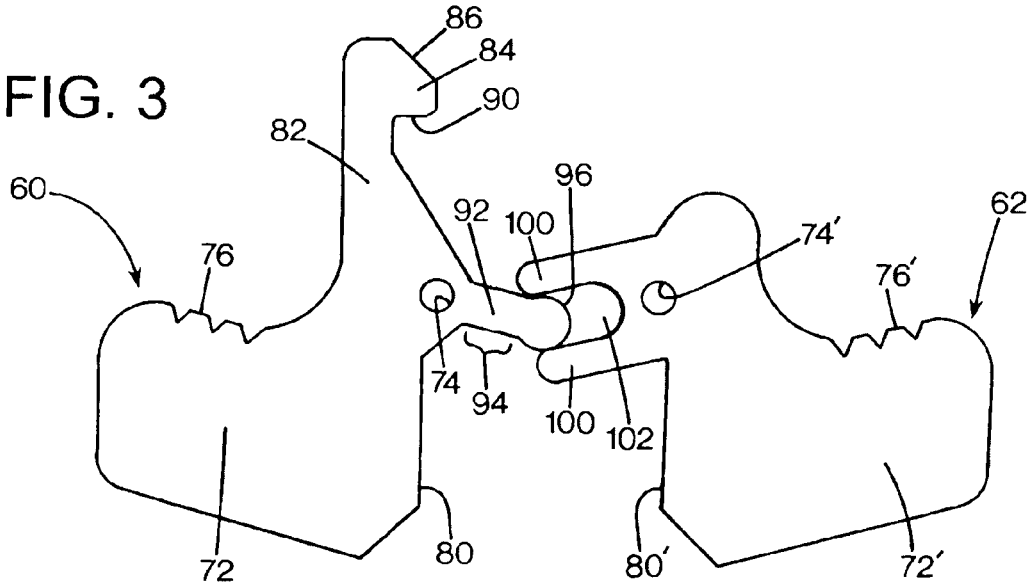
FIG. 3 is an enlarged view of the latch components of FIG. 1.

FIG. 3 shows the latch elements alone for clarity. The left latch element 60 has an L-shaped profile, with a lever portion 72 extending laterally from a pivot hole 74 that loosely receives the roll pin 70. A forward edge 76 of the lever portion faces forward, and defines serrations to facilitate a positive contact with an operator's finger. The forward edge is aligned laterally with the hole 74, so that the points on the forward edge follow substantially rearward arcs when the left latch pivots counterclockwise as viewed from above. The lever portion includes a spring contact surface 80 that faces medially, and is positioned directly rearward of the hole 74 so that the spring contact surface 80 follows a substantially rightward arc when the left latch pivots counterclockwise. The other portion of the "L" shape is a leg 82 that extends forward of the pivot hole 74. The leg includes a hook 84 extending medially. The hook that has a forward cam surface 86 that is angled to face forward and medially and a rearward facing catch surface 90. As thus far described, the left latch is essentially the same as a conventional latch of an M-16 rifle. However, the left latch also includes a medially-extending protrusion 92 in the form of a shaft 94 having a bulbous end portion 96. The shaft extends radially from the hole 74, and the end portion has a circular profile with a diameter greater than the width of the shaft.

The right latch 62 is in some respects a mirror image of the left latch 60, except that it lacks the leg 82 or any forward extension, and it has a pair of medially-extending protrusions 100 that define a channel 102 having a centerline extending radially from the hole 74' of the right latch. The channel has parallel sides spaced apart only slightly wider than the diameter of the end portion 96 of the left latch, so that the end portion is closely received in the channel as shown. The close fit of the end portion in the channel prevents looseness than can permit unwanted rattling sounds, and causes the latches to move in concert as one or the other is moved. The lever portion 72' of the right latch has a spring contact surface 80' that faces the opposed contact surface 80.

Referring back to FIG. 2, the latches are shown installed in the body. A compression coil spring 104 occupies the spring aperture 56, and has opposed ends that contact and bias apart the contact surfaces 80, 80'. This rotationally biases the left latch in a clockwise direction, and the right latch in a counterclockwise direction, each about their respective pivot points 74, 74'. The solid lines of FIG. 2 illustrate the latches in a rest or latched condition. In the latched condition, the hook 84 engages a recess 106 defined in the left side of the upper receiver 12, so that the hook's catch surface 90 engages a forward-facing rear surface 110 of the recess. This engagement prevents the charging handle from being withdrawn without actuation of either latch.

The latches are movable to a retracted position shown in dashed lines in FIG. 2. In this position, the forward edge 76, 76' of either or both latches is pulled by the operator to the rear, resulting in both edges moving to the rear, and the hook 84 disengaging from the receiver recess 106. This rearward pressure on the latch or latches also causes the charging handle to be withdrawn rearward from the receiver, cycling the rifle's bolt to an open condition. If the right latch's forward edge 74' is pulled back, the rearward one of the channel-defining legs 100 presses forward on the bulbous end 96 of the left latch's protrusion, so that the spring compresses between the spring contact points 80, 80' of the latches, resisting the motion. Thus, the right latch pivots clockwise, and the left latch pivots counterclockwise. Likewise, if the left latch's forward surface 76 alone is pulled back, the bulbous end 96 of the left latch's protrusion presses forward on the foreword one of the channel-defining legs 100 achieving the same result. If both latches are pulled, the same result occurs.

The forward aperture 54 is sized with adequate front-to-back width to allow motion of the protrusion 92 and legs 100, permitting the hook to fully engage the receiver when in the latched condition, and to allow the hook to fully clear the receiver and the forward edges 76, 76' to retract nearly flush with the forward surfaces of the crossbar. The use of a round protrusion on a narrower shaft in a parallel channel allows a consistently tight fit to be provided throughout the range of pivoting without binding. In alternative embodiments, involute gear geometry forms such as employed in conventional gear teeth may suitably be employed if wear is a concern, so that an entirely rolling contact is employed without any sliding of the surface of one latch with respect to the other. This may be achieved by having a conventional gear tooth on one latch, and a pair of such teeth surfaces on the other latch. In further alternative embodiments, any number of alternative mechanical linkages may employed to link the pivoting motion of the left latch to that of the right latch, and to constrain against relative movement between the latches. Moreover, the elements that engage the latches to each other may be reversed, so that the male element is on the right latch, and the female channel element is on the left latch having the hook element. Other embodiments for other rifles may employ different hook mechanisms, which may engage either or both sides or other surfaces of the receiver.

In the preferred embodiment, the pivot pins are spaced apart by a distance of 0.5". The slots 44, 46 have a width of 0.90", and the latches have a thickness of 0.125". The forward aperture 54 has a front to rear dimension of 0.40", and the spring aperture has a diameter of 0.188". The circular end element 96 of the left latch has a diameter of 0.125", with the shaft 94 having a width of 0.10". The channel 102 of the right latch has a width of 0.13, providing a close slip-fit with the element 96. While the body 26 is manufactured of Aluminum for lightness, and latches are formed of steel for durability. In alternative embodiments, the components may be made of any other suitable materials.

This disclosure is made in terms or preferred and alternative embodiments, and is not intended to be so limited.

The invention claimed is:

1. A charging handle for a rifle having a housing, the handle comprising:

a body having an elongated bar having a forward end and a rear end;

the bar having a bolt engaging element at the forward end;

a crossbar having an intermediate portion connected to the rear end of the bar;

the crossbar having opposed ends extending laterally of the bar;

first and second latch elements connected to the body;

the first latch element having a housing-engaging element operable to engage the housing when the handle is in a forward position;

the first and second latch elements being operably engaged to each other such that pivoting of the second latch element the disengages the housing-engaging element from the housing;

wherein one of the latch elements has a protrusion, and the other latch element has a recess defining a U-shaped gap, and wherein the protrusion is received in the recess to constrain the position of each latch element based on the position of the other latch element; and wherein the protrusion has an enlarged end portion with a selected width, and is connected to the rest of the latch element by a neck having a width less than the selected width, and wherein the protrusion extends radially from a first pivot axis about which the one latch element pivots, and where the recess has an opening facing away from a second pivot axis about which the other latch element pivots.

2. The handle of claim 1 wherein the latch elements are pivotally-connected to the body at pivot points that are fixed with respect to the body.

3. The handle of claim 2 wherein each latch element pivots about a different axis.

4. The handle of claim 2 wherein the latch elements are spring biased in opposite rotational directions.

5. The handle of claim 1 wherein the protrusion terminates in a circular knob having a selected diameter, and wherein the recess is a channel with parallel walls spaced apart by a distance to closely receive the knob.

6. The handle of claim 1 including a spring contacting each of the latch elements, such that the housing-engaging element is biased toward the housing.

7. The handle of claim 1 wherein the spring is a compression spring positioned between the latch elements.

8. The handle of claim 1 where in the body defines a major plane parallel to the bar and the cross bar, and wherein the crossbar defines a slot in a slot plane parallel to the major plane, and wherein at least planar portions of each latch element are received within the slot.

9. The handle of claim 8 wherein at least a portion of each latch element protrudes forwardly from the crossbar when the housing-engaging element is engaging the housing.

10. A latch mechanism for a rifle with a T-shaped charging handle operable to reciprocate with respect to a housing, the mechanism comprising:

a first latch element having a pivot aperture defining a first pivot axis, and sized to receive a pivot pin mounted to the charging handle in a fixed location;

a second latch element having a pivot aperture defining a second pivot axis, and sized to receive a pivot pin mounted to the charging handle in a fixed location;

the first pivot axis and second pivot axis remaining spaced apart by a fixed distance;

each latch element having an latch engaging element operable to engage the latch engaging element of the other latch element;

at least one of the latch elements having a housing-engaging element operable to engage the housing;

wherein one of the latch-engaging elements is a protrusion, and the other of the latch-engaging element is a recess defining a U-shaped gap and having an open end receiving the protrusion; and wherein the protrusion includes at least an enlarged end portion sized to be closely received in the recess.

11. The mechanism of claim 10 including a spring for biasing the housing engaging element toward the housing.

12. The mechanism of claim 11 wherein each latch element includes a spring contact portion for contacting the spring.

13. The mechanism of claim 12 wherein the spring contacting portion of the at least one latch element having a housing-engaging element being generally radially opposed from the housing engaging element with respect to the pivot aperture.

14. The mechanism of claim 12 wherein the first and second latch elements include planar portions occupying a common plane perpendicular to the pivot axis of each latch element, and wherein the protrusion and recess are formed as peripheral surfaces of the planar portions.

15. A latch mechanism for a rifle with a T-shaped charging handle operable to reciprocate with respect to a housing, the mechanism comprising:

a first latch element having a pivot aperture defining a first pivot axis, and sized to receive a pivot din mounted to the charging handle in a fixed location;

a second latch element having a pivot aperture defining a second pivot axis, and sized to receive a pivot pin mounted to the charging handle in a fixed location;

the first pivot axis and second pivot axis remaining spaced apart by a fixed distance;

each latch element having an latch engaging element operable to engage the latch engaging element of the other latch element;

at least one of the latch elements having a housing-engaging element operable to engage the housing;

wherein one of the latch-engaging elements is a protrusion, and the other of the latch-engaging element is a recess defining a U-shaped gap and having an open end receiving the protrusion; and wherein the protrusion has a bulbous end sized to be closely received within the recess, and to slide within the recess in response to operational motion of the latches.

16. The mechanism of claim 10 wherein the recess is a channel having an open end extending away from the pivot aperture, and having parallel walls.

* * * * *